US007342162B2

(12) United States Patent
Tai

(10) Patent No.: US 7,342,162 B2
(45) Date of Patent: Mar. 11, 2008

(54) MUSICAL INSTRUMENT STAND

(75) Inventor: Jonathan Tai, Shanghai (CN)

(73) Assignee: Shanghai Max Precision Instrument Co., Ltd., Shanghai (CN)

( * ) Notice: Subject to any disclaimer, the term of this patent is extended or adjusted under 35 U.S.C. 154(b) by 0 days.

(21) Appl. No.: 11/466,175

(22) Filed: Aug. 22, 2006

(65) Prior Publication Data

US 2008/0006139 A1 Jan. 10, 2008

Related U.S. Application Data

(63) Continuation of application No. 29/247,726, filed on Jul. 6, 2006.

(51) Int. Cl.
*G10D 3/00* (2006.01)

(52) U.S. Cl. ..... 84/327

(58) Field of Classification Search ..... 84/327, 84/329, 421, 290; 248/443; 206/314
See application file for complete search history.

(56) References Cited

U.S. PATENT DOCUMENTS

| | | | | |
|---|---|---|---|---|
| 230,851 | A | 8/1880 | Anthony | |
| 368,426 | A | 8/1887 | Rutmann | |
| 575,729 | A | 1/1897 | Palmer | |
| 730,062 | A | 6/1903 | Widmer | |
| 1,359,811 | A | 11/1920 | Kirkendall | |
| 1,673,205 | A | 6/1928 | Romao | |
| 1,684,912 | A | 9/1928 | Dunklau | |
| 1,862,562 | A | 6/1932 | Aldeen | |
| 1,863,756 | A | 6/1932 | Lufkin | |
| 2,547,924 | A | 4/1951 | Citro | |
| 2,559,200 | A | 7/1951 | Schaf | |
| 2,630,289 | A | 3/1953 | Selig | |
| 2,727,708 | A | 12/1955 | Lorenzen | |
| 2,940,709 | A | 6/1960 | Neuwirth | |
| 3,057,591 | A | 10/1962 | Weimer | |
| 3,526,380 | A | 9/1970 | Tong | |
| D223,638 | S | 5/1972 | Smith | |
| 3,709,454 | A | 1/1973 | Hyde | |
| 3,804,355 | A | 4/1974 | Uroshevich | |
| 3,881,675 | A | 5/1975 | Matchett | |
| D236,227 | S | 8/1975 | Kester, Jr. | |
| 3,938,772 | A | 2/1976 | Andrusiak | |
| 3,958,786 | A | 5/1976 | Mann | |
| 4,010,922 | A | 3/1977 | Heller | |
| 4,061,302 | A | 12/1977 | Boone | |
| 4,099,441 | A | 7/1978 | Landon | |
| 4,102,237 | A * | 7/1978 | Suess et al. | 84/421 |
| 4,205,818 | A | 6/1980 | Lawler | |
| 4,317,552 | A | 3/1982 | Weidler | |
| 4,352,480 | A | 10/1982 | Gathright | |
| 4,561,339 | A | 12/1985 | Jensen | |
| 4,582,282 | A | 4/1986 | Gracie | |
| 4,671,479 | A | 6/1987 | Johnson | |
| 4,691,610 | A | 9/1987 | Gilbert | |
| 4,693,161 | A | 9/1987 | Uhrig | |

(Continued)

*Primary Examiner*—Kimberly Lockett
(74) *Attorney, Agent, or Firm*—William W. Cochran; Cochran Freund & Young LLC

(57) ABSTRACT

Disclosed are a musical instrument stand and a musical instrument stand and musical instrument hanger that are portable and compact. The device has a wide, sturdy base that is capable of holding musical instruments without marring or scratching the finish of the musical instruments. In addition, in accordance with one embodiment, the device can be used as a hanger to hang musical instruments from a wall.

8 Claims, 9 Drawing Sheets

U.S. PATENT DOCUMENTS

| | | | | |
|---|---|---|---|---|
| 4,695,021 | A | | 9/1987 | Leinfelder |
| 4,712,756 | A | | 12/1987 | Kester |
| 4,744,536 | A | | 5/1988 | Bancalari |
| 4,785,708 | A | | 11/1988 | Vaughan |
| D299,244 | S | | 1/1989 | Jones |
| 4,807,837 | A | | 2/1989 | Gawlik |
| 4,890,531 | A | | 1/1990 | Tischer |
| 4,923,156 | A | | 5/1990 | Linneusson |
| 5,029,796 | A | | 7/1991 | Schoenig |
| 5,037,057 | A | | 8/1991 | Andrews |
| 5,060,894 | A | | 10/1991 | Hillinger |
| 5,114,111 | A | | 5/1992 | Andrews |
| 5,165,635 | A | | 11/1992 | Hoshino |
| D332,882 | S | | 2/1993 | Graves |
| 5,197,701 | A | | 3/1993 | Olson |
| 5,213,296 | A | | 5/1993 | Lee |
| 5,340,066 | A | | 8/1994 | Ditch |
| 5,350,143 | A | | 9/1994 | Hoshino |
| D353,729 | S | | 12/1994 | MacOwan |
| 5,375,497 | A | | 12/1994 | Pirchio |
| 5,383,634 | A | | 1/1995 | Liao |
| D356,901 | S | | 4/1995 | Schoenig |
| D357,828 | S | | 5/1995 | Liao |
| 5,454,473 | A | | 10/1995 | Hennessey |
| 5,497,689 | A | | 3/1996 | Hoshino |
| 5,505,413 | A | | 4/1996 | Hennessey |
| D375,003 | S | | 10/1996 | Nordstrom, Jr. |
| 5,664,756 | A | | 9/1997 | Liao |
| 5,692,719 | A | | 12/1997 | Shepherd |
| 5,713,547 | A | | 2/1998 | Yu |
| D392,123 | S | | 3/1998 | Lynch |
| 5,726,369 | A | | 3/1998 | Gilday |
| 5,744,735 | A | | 4/1998 | Liao |
| D394,764 | S | | 6/1998 | Nordstrom |
| D396,597 | S | | 8/1998 | Hollinger |
| 5,836,552 | A | | 11/1998 | Yu |
| 5,852,250 | A | | 12/1998 | Cha |
| D408,179 | S | | 4/1999 | Rellinger |
| D411,698 | S | | 6/1999 | Kalayjian |
| 5,934,628 | A | | 8/1999 | Bosnakovic |
| 5,957,417 | A | | 9/1999 | Yu |
| 5,959,225 | A | | 9/1999 | Hsu |
| D414,962 | S | | 10/1999 | Welsh |
| 5,973,244 | A | | 10/1999 | McCulloch |
| 5,977,464 | A | * | 11/1999 | Bencomo, Jr. ..... 84/421 |
| 6,005,176 | A | | 12/1999 | Yu |
| D419,707 | S | | 1/2000 | Tierney |
| 6,015,121 | A | | 1/2000 | Reid |
| D421,447 | S | | 3/2000 | Eason |
| 6,036,159 | A | | 3/2000 | Yu |
| 6,113,040 | A | | 9/2000 | Yu |
| 6,127,612 | A | | 10/2000 | Yu |
| D435,365 | S | | 12/2000 | Eason |
| 6,209,829 | B1 | | 4/2001 | Yu |
| 6,281,417 | B1 | | 8/2001 | Ladao |
| 6,283,421 | B1 | | 9/2001 | Eason |
| 6,323,405 | B1 | | 11/2001 | Yu |
| 6,375,135 | B1 | | 4/2002 | Eason |
| 6,439,532 | B1 | | 8/2002 | Yu |
| 6,513,768 | B1 | | 2/2003 | Hsieh |
| 6,682,042 | B2 | | 1/2004 | Anderson |
| D509,162 | S | | 9/2005 | Barnes |
| 2002/0070319 | A1 | | 6/2002 | Yu |
| 2002/0088914 | A1 | | 7/2002 | Yu |

* cited by examiner

MUSICAL INSTRUMENT STAND

CROSS-REFERENCE TO RELATED APPLICATION

This application is a continuation of U.S. Design application Ser. No. 29/247,726, filed Jul. 6, 2006, entitled "Guitar Stand" by Jonathan Tai, the entire contents of which is hereby specifically incorporated herein for all that it discloses and teaches.

BACKGROUND OF THE INVENTION

Musical instrument stands are useful devices that allow musicians to place their musical instruments in a device that allows easy access to the musical instrument and holds the musical instrument in an upright position. Typical instrument stands are bulky and are difficult to carry while traveling. It would therefore be desirable to have a musical instrument stand that can be used for fixed or portable use, compact and can hold a musical instrument in an upright and secure position that will not damage the musical instrument.

SUMMARY OF THE INVENTION

An embodiment of the present invention may therefore comprise a musical instrument stand that supports musical instruments having body portions comprising: a base that is formed in a rounded annulus that creates a central opening and two side portions on opposite sides of the central opening, the two side portions recessed to form a first groove that supports a body portion of a first musical instrument, the two side portions having a second groove that supports a body portion of a second musical instrument, the second groove being smaller than the first groove and disposed inside the first groove, the two side portions providing two separated support locations for the body portions of the musical instruments; a support arm that is pivotally attached to the base that pivots from a closed position to an open position; a support head attached to the support arm that provides a third support location for the body portions of the musical instruments; protective pads disposed on the base and the support head that prevent the body portions of the musical instruments from damage.

The present invention may further comprise a method of supporting musical instruments having body portions using a musical instrument stand comprising: providing a base that is formed in a rounded annulus that creates a central opening and two side portions on opposite sides of the central opening, the two side portions recessed to form a first groove that supports a body portion of a first musical instrument, the two side portions having a second groove that supports a body portion of a second musical instrument, the second groove being smaller than the first groove and disposed inside the first groove, the two side portions providing two separated support locations for the body portions of the musical instruments; providing a support arm that has a support head; pivotally attaching the support arm to the base so that the support arm and the support head pivot between a closed position and an open position; supporting the body portions of the musical instruments at a third support location with the support head when the support arm is located in the open position.

DETAILED DESCRIPTION OF THE EMBODIMENTS

Figure 1:
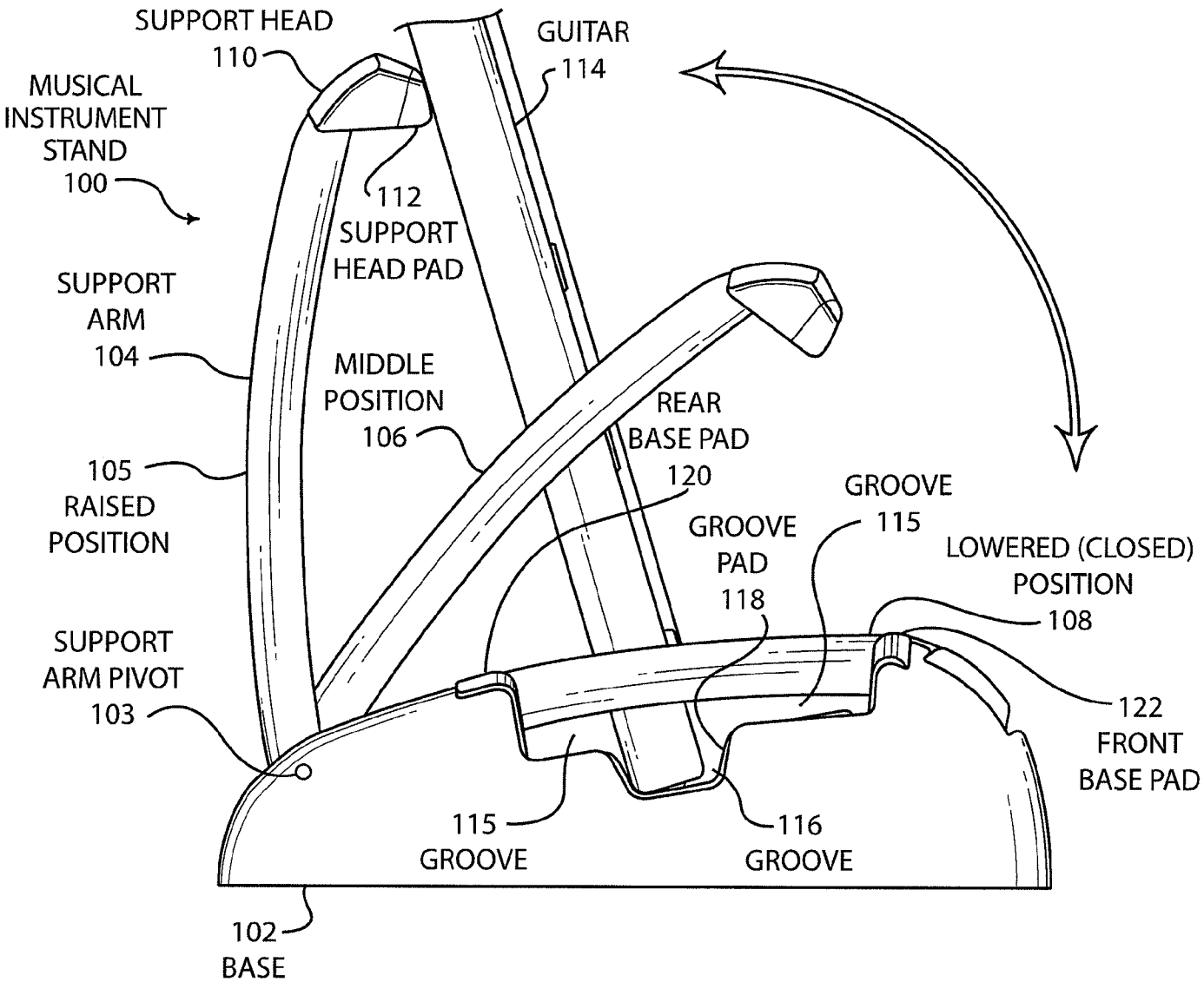
FIG. 1 is a side view of one embodiment of the present invention illustrating a support arm in several positions.

FIG. 1 is a side view of one embodiment of a musical instrument holder. As shown in FIG. 1, the musical instrument holder includes a base 102 and a support arm 104 that is shown in FIG. 1 in a raised position 105, a middle position 106 and a lower position 108. In the raised position 105, the body of the instrument, such as the body of guitar 114, rests against a support head pad 112 of a support head 110 that is located on the support arm 104. The bottom of the musical instrument rests in a groove 116 across the base 102. A groove pad 118 is a soft padded material that is disposed in the groove 116 to protect the guitar 114 from damage. In addition, a rear base pad 120 and a front base pad 122 are also made of a soft padded material and are disposed in a larger groove 115 in the base 102. The larger groove 115 in base 102 is capable of accommodating the body of larger musical instruments, such as acoustic guitars, cellos, etc., while the groove 116 is capable of accommodating instruments with smaller bodies, such as electric guitars, violins, etc. The rear base pad 120 and the front base pad 122 prevent the body of the larger instruments from being scratched or otherwise damaged on the base 102. The base 102 and support arm 104 can be made of a plastic material that is durable and will not easily break. The support arm 104 rotates around a support arm pivot 103 from a raised position 105 to the lowered position 108. In the raised position 105, the base of the support arm 104 contacts a stop to prevent further rotation of the arm in a counterclockwise direction, as shown in FIG. 1. Frictional indents or snap locks (not shown) can also be provided that hold the support arm 104 in a stationary upright position 105. In the lower position, the support head 110 of the support arm 104 fits in a support head detent 120 (FIG. 2).

Figure 2:
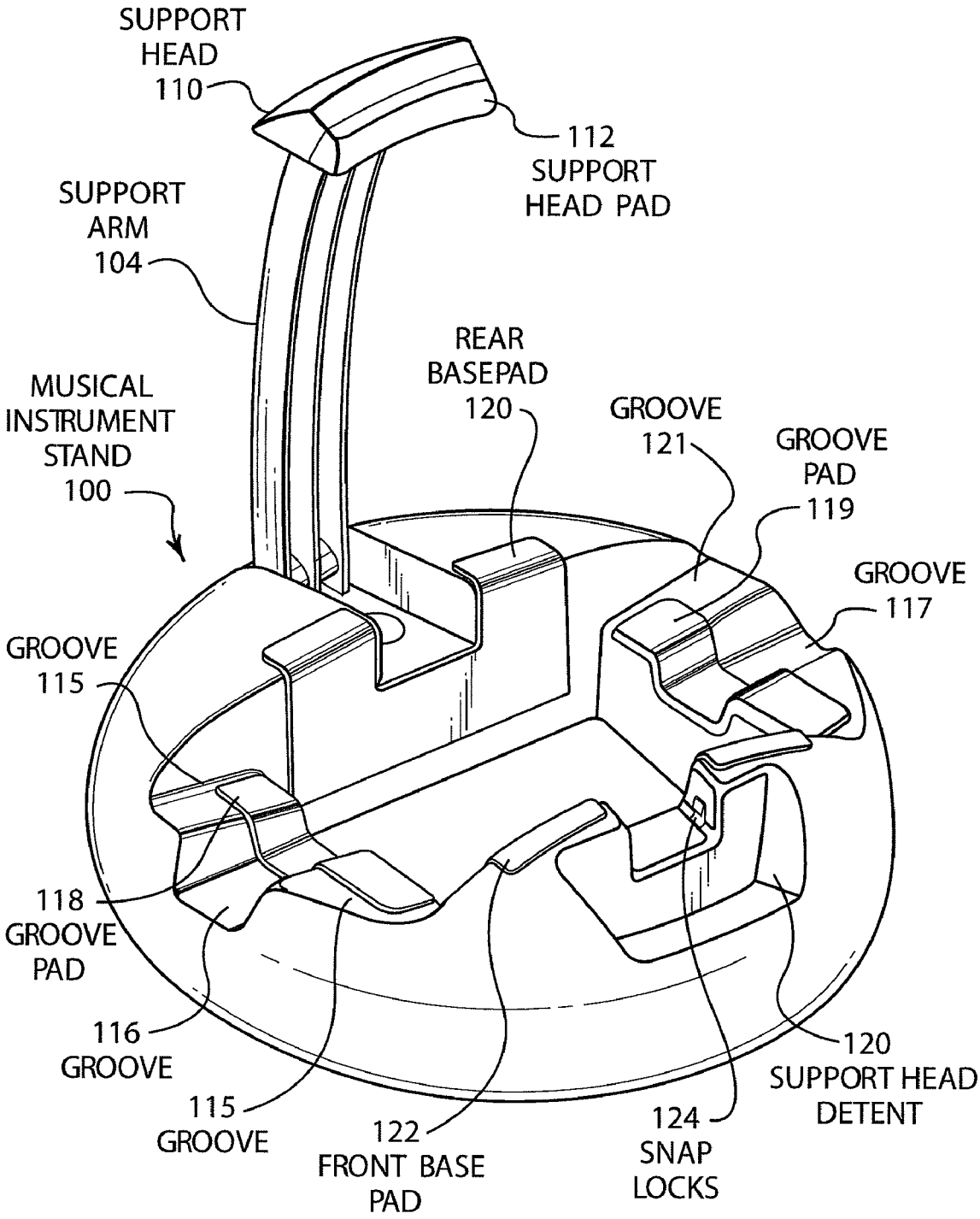
FIG. 2 is an isometric view of the embodiment of FIG. 1.

FIG. 2 is an isometric diagram of the embodiment of a musical instrument stand 100 of FIG. 1. As shown in FIG. 2, the support arm 104 is in the extended upright position 105 and includes a support head pad 112 that is made from a soft material that will prevent the body of a musical instrument, such as guitar 114, from being scratched or otherwise damaged.

FIG. 2 illustrates groove 116 and groove 117 in which a musical instrument with a smaller body can rest on the groove pads 118, 119, respectively. Grooves 116 and 117 are located on opposite sides of the annulus of the base 102 and provide two spatially separated supports for a smaller musical instrument. The rear base pad 120 and the front base pad 122 comprise padding for the grooves 115 and 121 that is used for musical instruments having a larger body, such as acoustic guitars, etc., as set forth above. Grooves 115 and 121 are also located on opposite sides of the annulus of the base 102 and provide two spatially separated supports for larger musical instruments. The support head 110 and support head pad 112 fit into the support head detent 120 to provide a smooth, curved surface along the base when the support arm 104 is in the lowered position 108. Snap locks 124 hold the support arm 104 in the lowered (closed) position.

Figure 3:
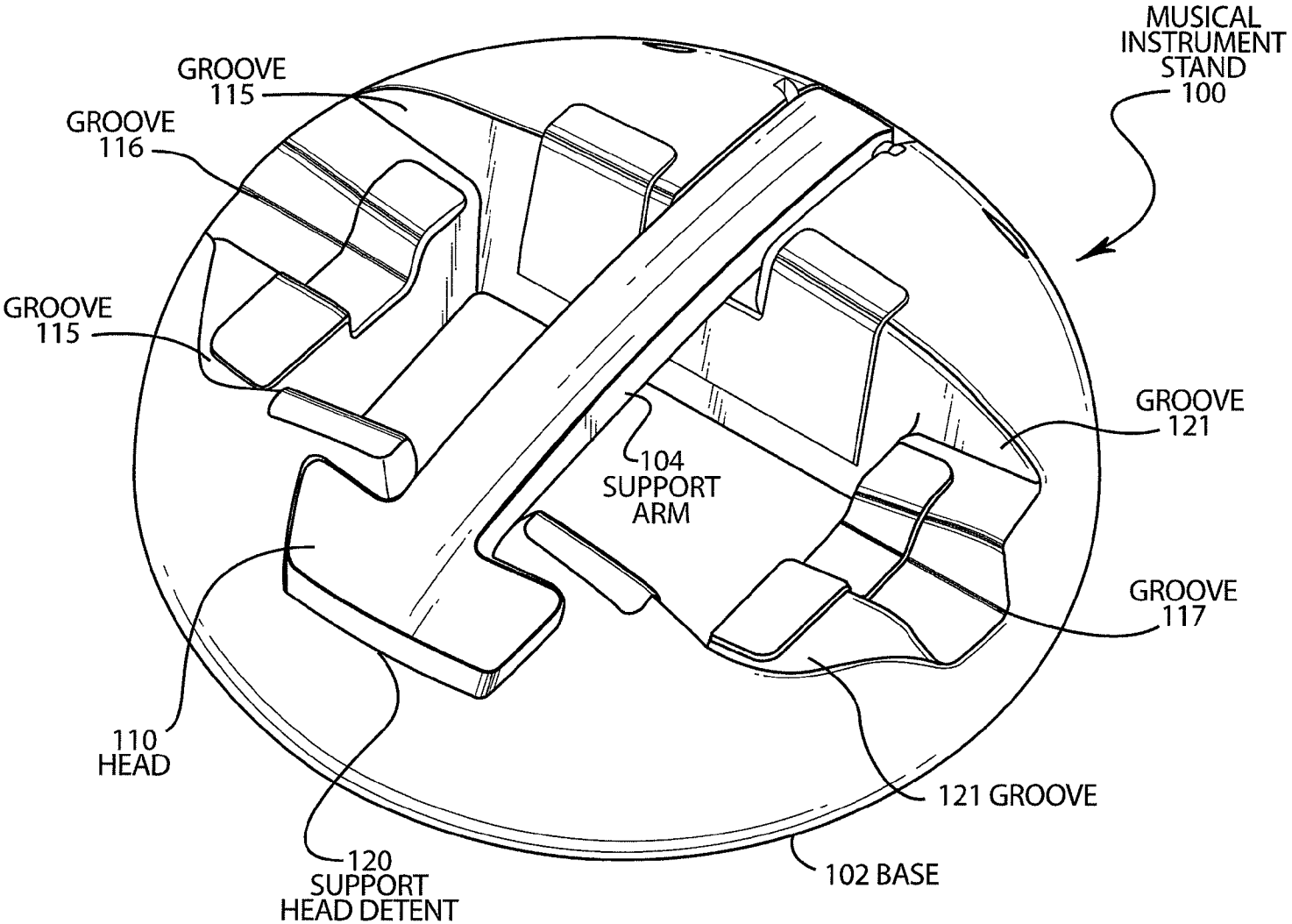
FIG. 3 is another isometric view of the embodiment of FIG. 1.

FIG. 3 is an isometric diagram illustrating the musical instrument stand 100 of the embodiment of FIG. 1. As shown in FIG. 3, the support head 100 fits into the support head detent 120 so that a smooth, rounded surface is formed along the outer surface of the base 102 of the musical instrument stand 100. In the closed position, as illustrated in FIG. 3, the musical instrument stand 100 provides a compact, lightweight musical instrument stand that can be used in a portable manner and transported to different locations in a simple and easy fashion. The musical instrument stand 100 can be made of a lightweight, durable plastic to provide durability and usability of the stand 100. FIG. 3 also illustrates the larger grooves 115, 121 that fit larger instruments, such as acoustic guitars, and the smaller grooves 116, 117 that fit smaller body instruments, such as electric guitars. The grooves 115, 121 and grooves 116, 117 are disposed on opposite sides of the annulus of the base 102 to provide a spatially separated set of supports for the bodies of the musical instruments. In other words, the recessed portions of the base 102 created by the grooves provide two spatially separated support locations on the base 102 for supporting the bodies of the musical instruments.

Figure 4:
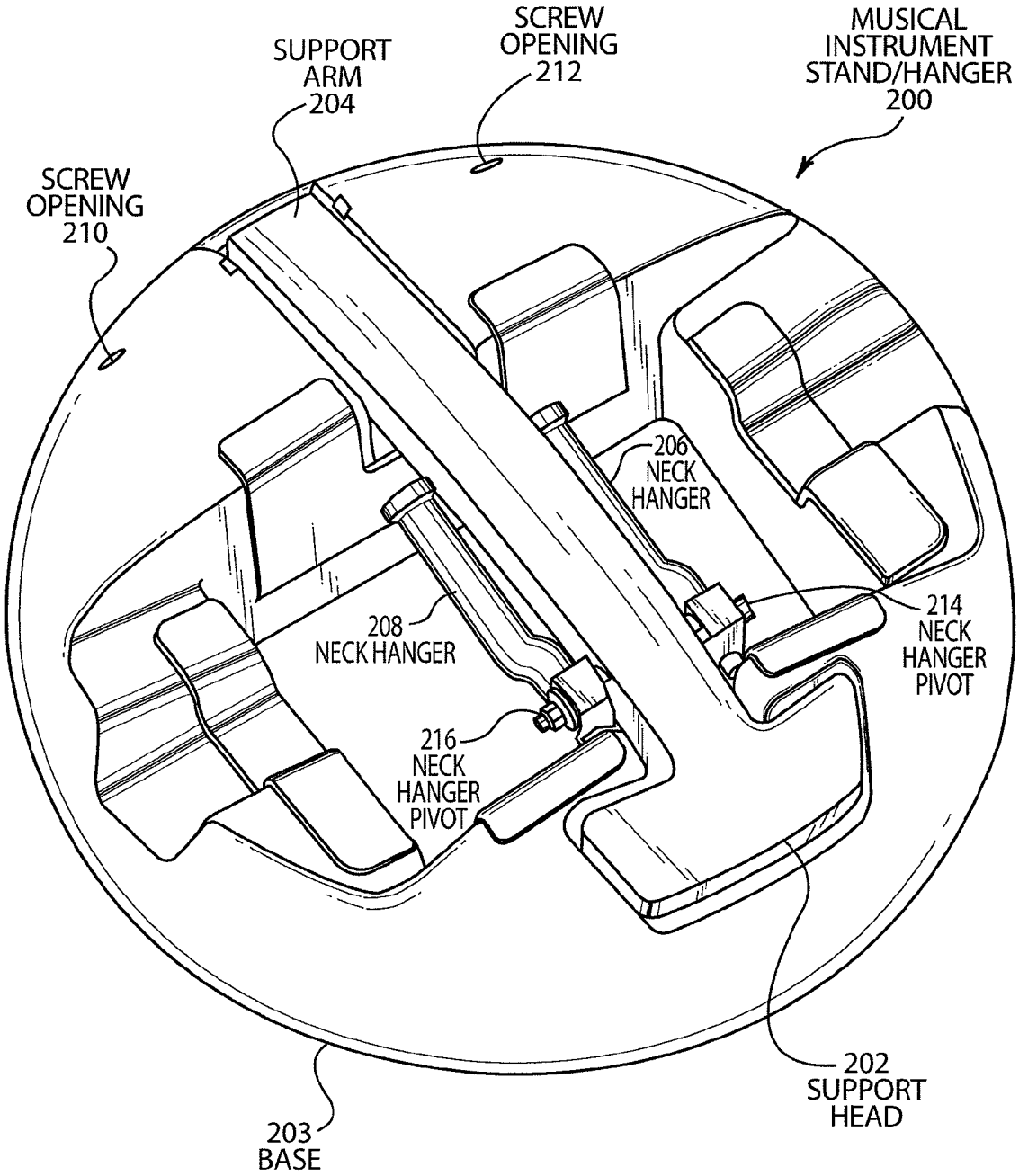
FIG. 4 is an isometric view of another embodiment of the present invention illustrating the musical instrument stand in a folded position.

FIG. 4 is an isometric diagram of another embodiment of a musical instrument stand and musical instrument hanger 200. As shown in FIG. 4, the stand/hanger 200 is similar to the embodiment of FIG. 1 with the addition of neck hangers 206, 208 that are pivotally attached to the support arm 204 with neck hanger pivots 214, 216, respectively. The neck hanger pivots 214, 216 are located on the support arm 204 just slightly down from the support head 202. In that fashion, the neck hangers 206, 208 are recessed in the central opening of the base 203 of the stand/hanger 200. As disclosed below, the pivots 214, 216 rotate outwardly from the arm 204 to provide a support for hanging a musical instrument by the tuning (stock) head or tuning pegs of the musical instrument. Screw openings 210, 212 are provided in the base 203 for mounting the stand/hanger 200 on a wall.

Figure 5:
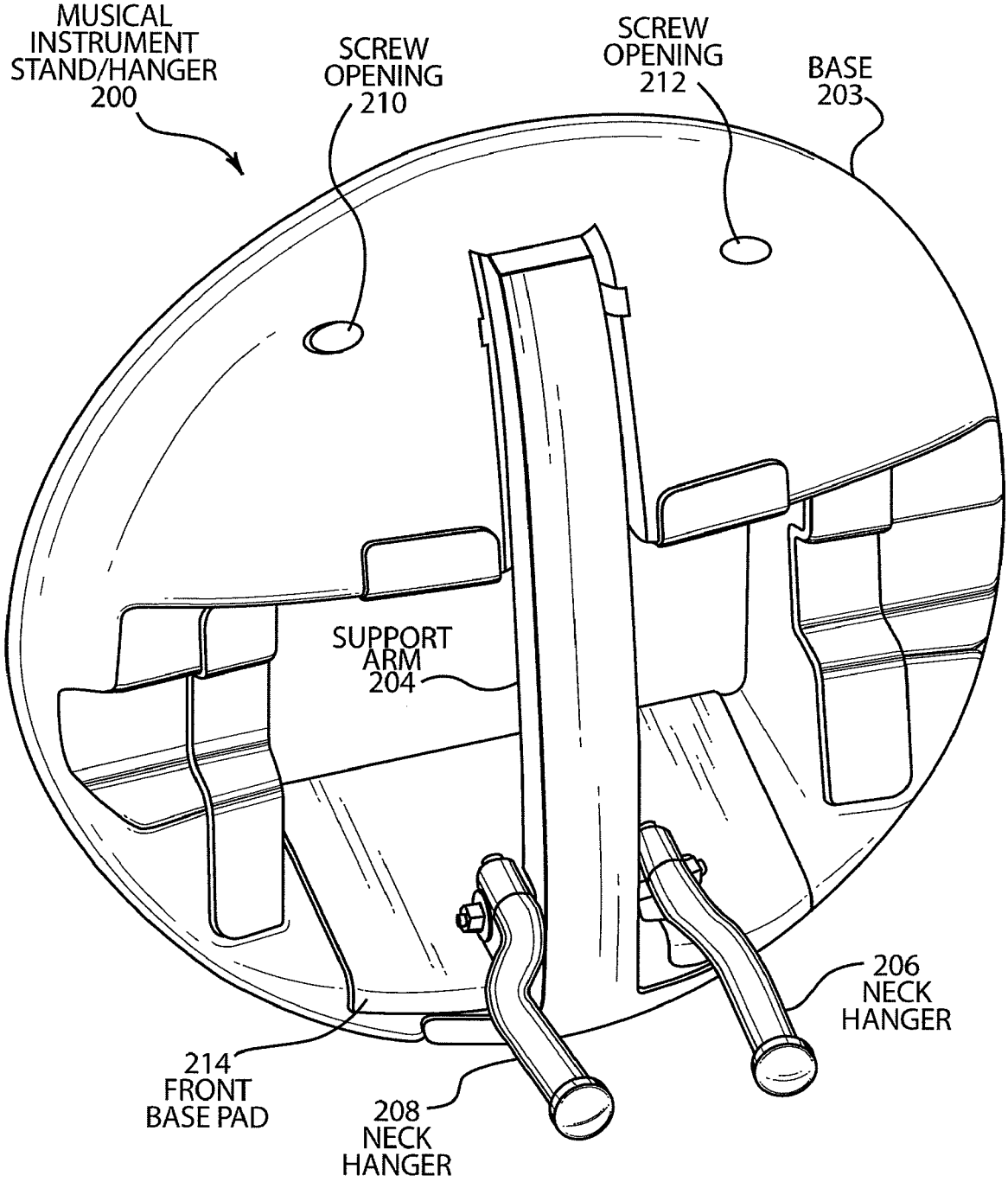
FIG. 5 is an isometric view of the embodiment of FIG. 4.

FIG. 5 is another isometric view of the embodiment of FIG. 4 showing the neck hangers 206, 208 rotated in an outward position. As shown in FIG. 5, the base 203 is positioned in a vertical orientation. The arm 204 is in a closed position in downward direction. Hangers 206, 208 are rotated outwardly from the arm 204 and rest against the front pad 214 on the base 203 and are prevented from further rotation. The neck hangers 206, 208 are adapted to hold the tuning head (stock head) or tuning pegs of a musical instrument when the base 203 is mounted on a vertical surface, such as a wall, using screw openings 210, 212.

Figure 6:
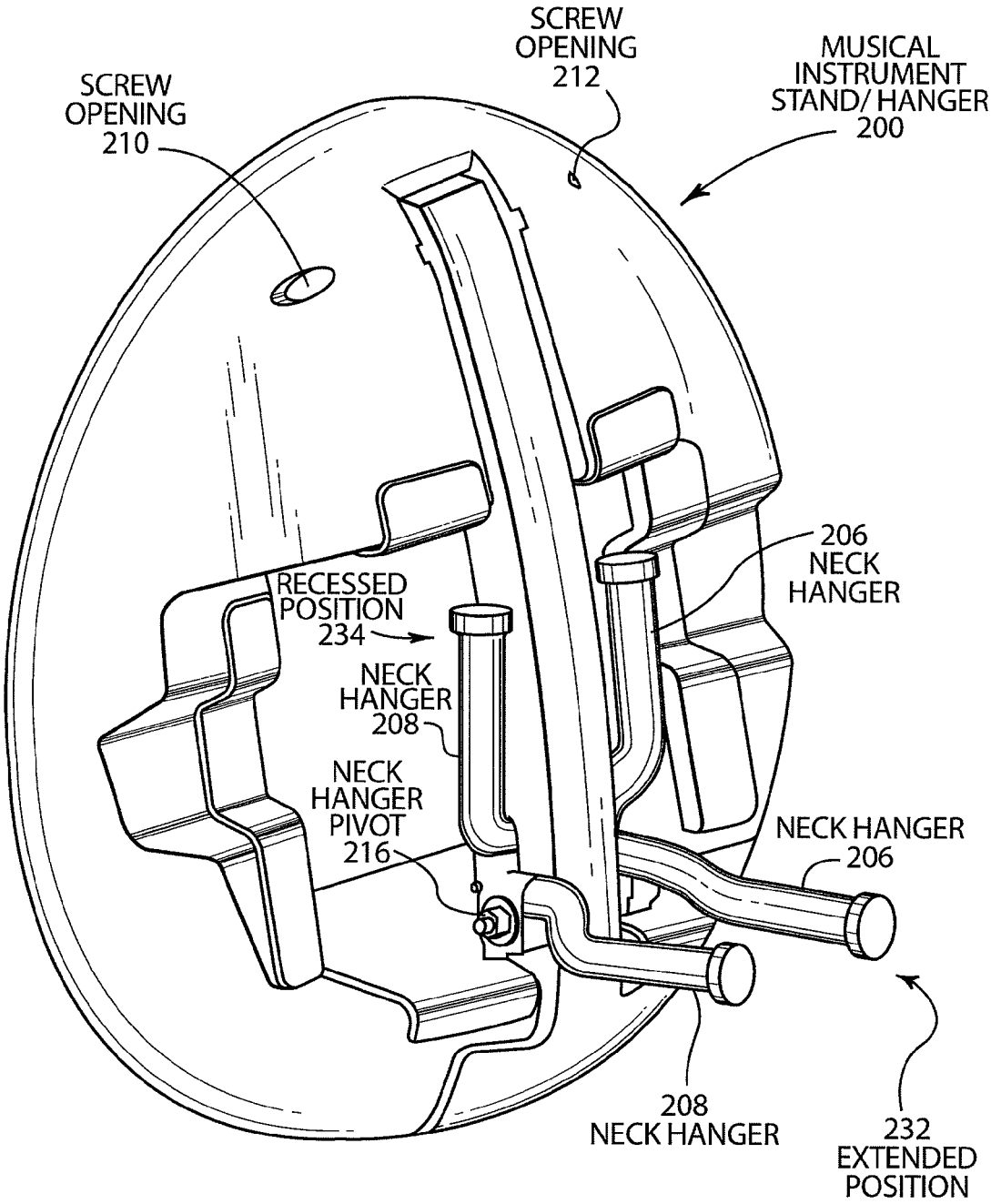
FIG. 6 is another isometric view of the embodiment of FIG. 4.

FIG. 6 is another isometric diagram of the embodiment of a musical instrument stand/hanger 200 of FIG. 4. FIG. 6 illustrates the neck hangers 206, 208 in the extended position 232 and the recessed position 234. The neck hangers 206, 208 may be placed in the recessed position 234 when the musical instrument stand/hanger 200 is being used as a stand or when it is not being used as a hanger, such as when the musical instrument stand/hanger 200 is being transported.

Figure 7:
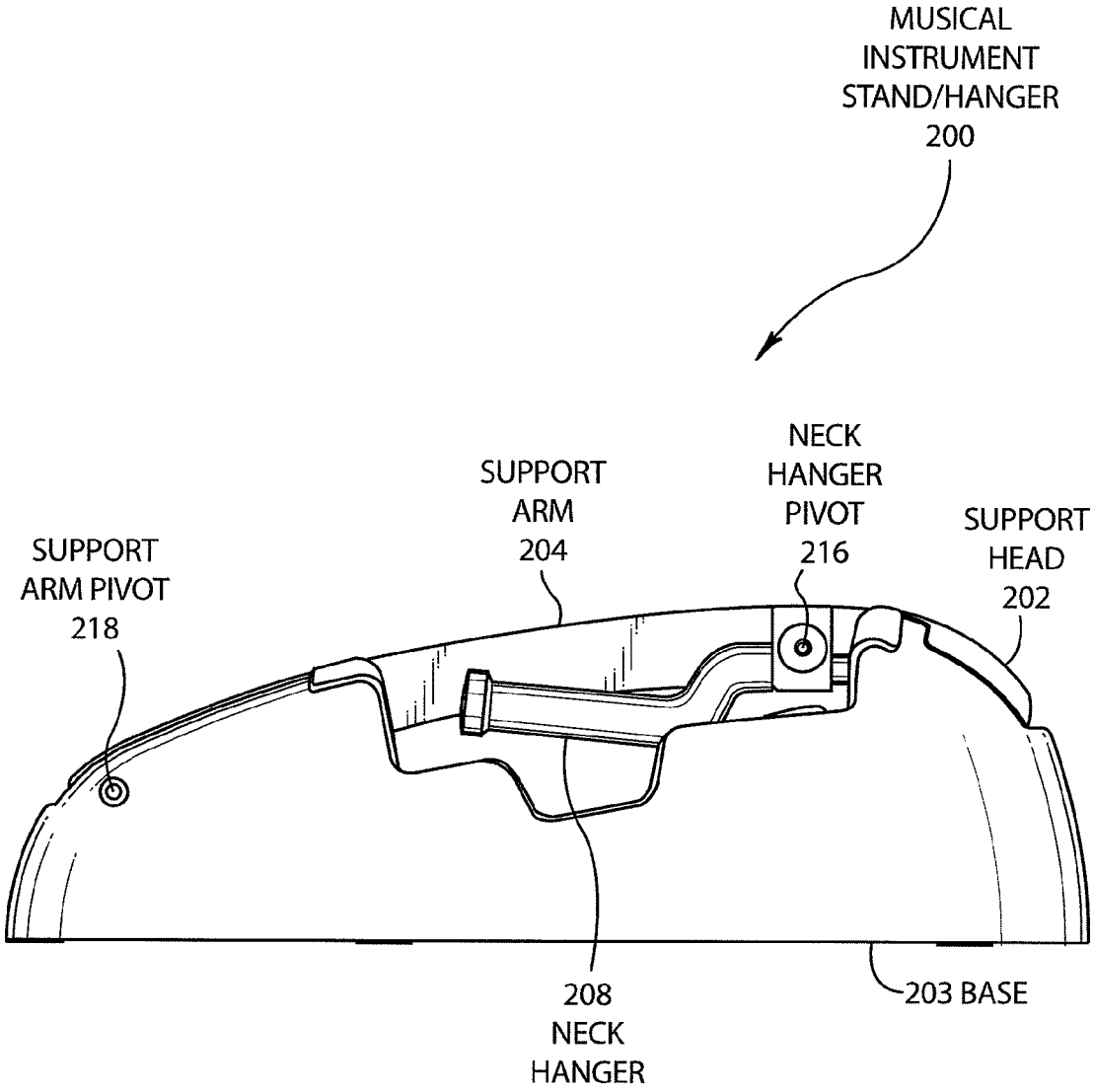
FIG. 7 is a side view of the embodiment of FIG. 4.

FIG. 7 is a side view of the musical instrument stand/hanger 200 in a closed position. As illustrated in FIG. 7, neck hanger 206 (not shown) and neck hanger 208 are rotated to a recessed position 234 (FIG. 6) along the side of the support arm 204 using pivot 214 (FIG. 4) and pivot 216, respectively. The support head 202 (FIG. 4) is recessed into the base 203 so that the head 202 forms a smooth, curved surface with base 203. The support arm 204 pivots on support arm pivot 218 from the closed position, as shown in FIG. 7, to an open position, such as shown in FIG. 2. In the open position, the musical instrument stand/hanger 200 can be used as a musical instrument stand in the same manner as the embodiment of FIG. 1. When being used as a stand, the neck hangers 206, 208 are kept in a recessed position, such as illustrated in FIG. 7.

Figure 8:
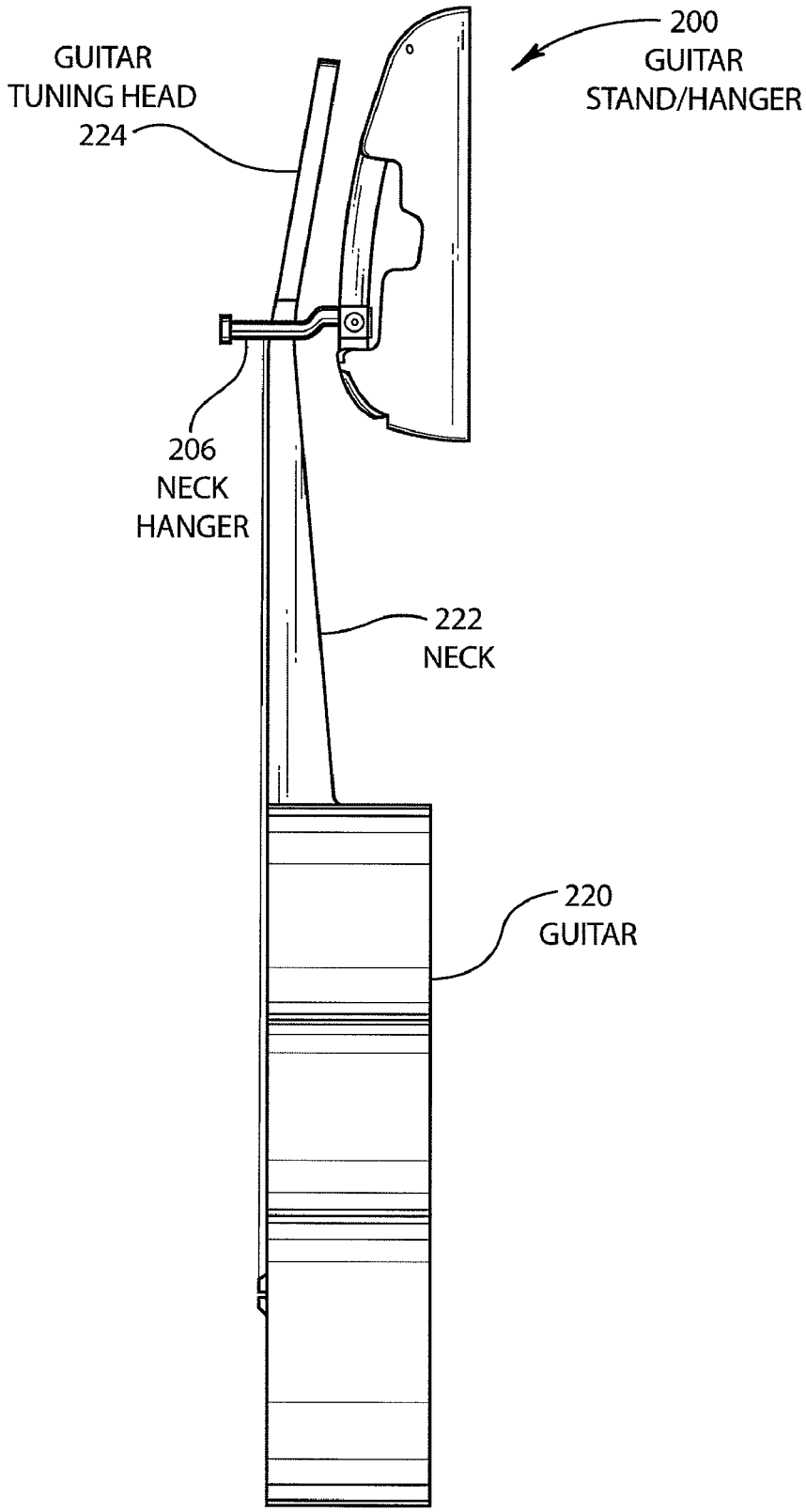
FIG. 8 is a side view of the embodiment of FIG. 4 illustrating the manner in which the musical instrument stand can hold an instrument.

FIG. 8 is a side view of the musical instrument stand/hanger 200 that is mounted on a vertical mounting surface 230 (FIG. 9) and that is being used to hold a guitar 220 using the neck hangers 206, 208. As shown in FIG. 8, the neck 222 of the guitar 220 is positioned in between neck hangers 206, 208. The guitar tuning head (stock head) 224 rests against the neck hangers 206, 208 and suspends the guitar 220 from the musical instrument stand/hanger 200. Of course, any type of instrument having a neck can use the musical instrument stand/hanger 200 including violins, cellos, basses, acoustic guitars, electric guitars, mandolins, ukuleles, etc. Musical instruments that do not have tuning heads, such as violins, cellos, etc., can be hung from tuning pegs.

Figure 9:
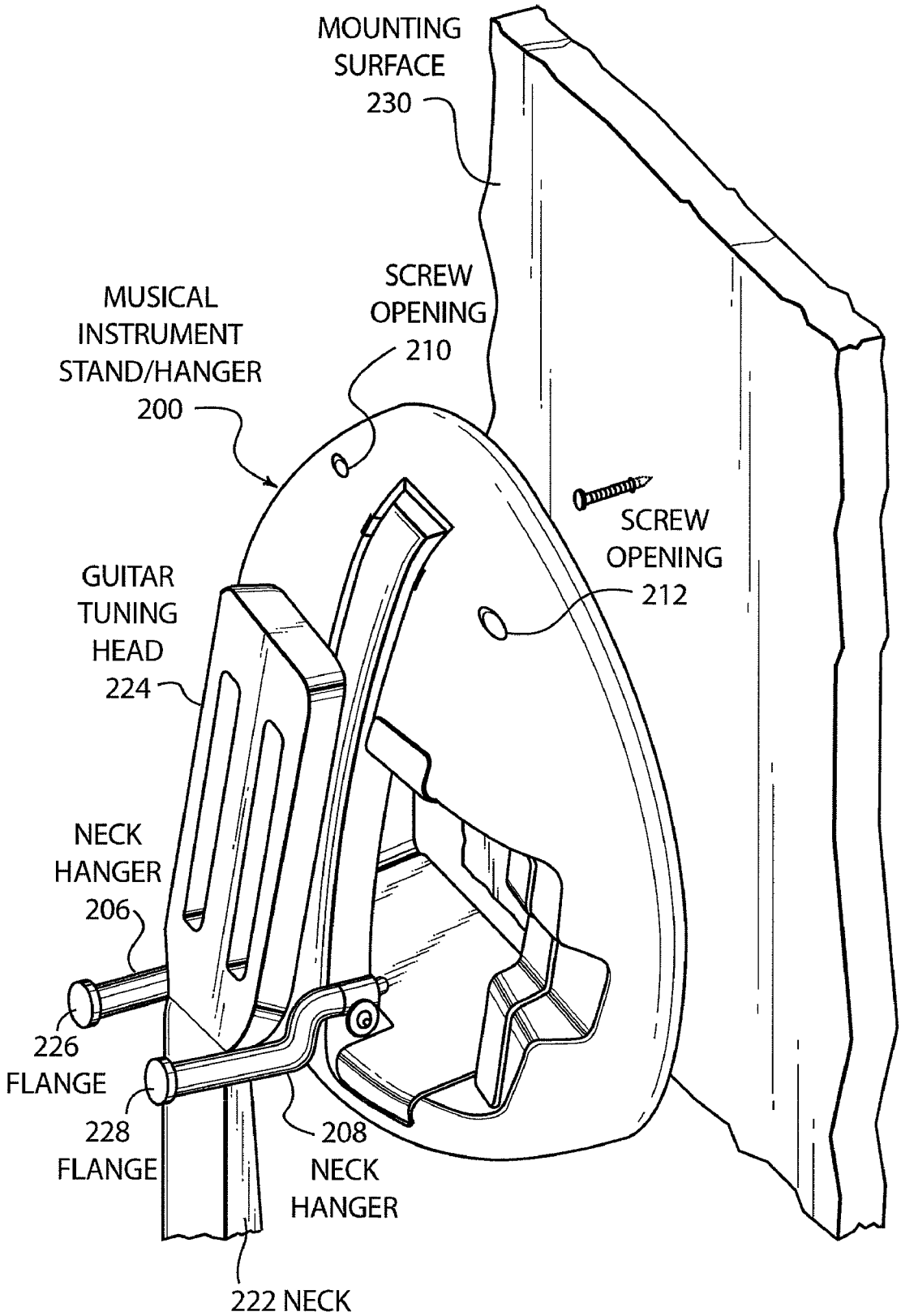
FIG. 9 is an isometric view of the embodiment of FIG. 4 illustrating the manner in which the musical instrument stand can hold an instrument.

FIG. 9 is a close-up view illustrating the manner in which the musical instrument stand/hanger 200 can be used as a musical instrument hanger. As shown in FIG. 9, screw openings 210, 212 are used to mount the musical instrument stand/hanger on a mounting surface 230. This can be a wall or other desired mounting surface. The neck hangers 206, 208 are extended to an outward position so that the neck 222 is positioned between the neck hangers 206, 208. The guitar neck head 224 rests on the neck hangers 206, 208, as illustrated in FIG. 9, to support the guitar 222. Flanges 226, 228 at the end of the neck hangers 206, 208, respectively, prevent the guitar from sliding off of the neck hangers 206, 208.

Hence, the embodiments disclosed herein provide a convenient and compact musical instrument stand and musical instrument stand/hanger that can be used as a fixed hanger device or as a portable stand. The device is lightweight and compact and provides padded surfaces that do not mar or scratch the musical instrument. The stand is constructed to take narrow body instruments, such as electric guitars, and wide body instruments, such as acoustic guitars.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A musical instrument stand that supports musical instruments having body portions comprising:

a base that is formed in a rounded annulus that creates a central opening and two side portions on opposite sides of said central opening, said two side portions recessed to form a first groove that supports a body portion of a first musical instrument, said two side portions having a second groove that supports a body portion of a second musical instrument, said second groove being smaller than said first groove and disposed inside said first groove, said two side portions providing two separated support locations for said body portions of said musical instruments;

a support arm that is pivotally attached to said base that pivots from a closed position to an open position;

a support head attached to said support arm that provides a third support location for said body portions of said musical instruments;

protective pads disposed on said base and said support head that prevent said body portions of said musical instruments from damage.

2. The musical instrument stand of claim 1 further comprising:

a head detent in said base that allows said head to be recessed in said base when said support arm is in said closed position.

3. The musical instrument stand of claim 2 wherein said first musical instrument is an acoustic guitar and said second musical instrument is an electric guitar.

4. The musical instrument stand of claim 1 further comprising:

two neck hangers pivotally attached to said support arm adjacent to said support head that pivot to an extended position that supports a tuning head of musical instruments.

5. A method of supporting musical instruments having body portions using a musical instrument stand comprising:

providing a base that is formed in a rounded annulus that creates a central opening and two side portions on opposite sides of said central opening, said two side portions recessed to form a first groove that supports a body portion of a first musical instrument, said two side portions having a second groove that supports a body portion of a second musical instrument, said second groove being smaller than said first groove and disposed inside said first groove, said two side portions providing two separated support locations for said body portions of said musical instruments;

providing a support arm that has a support head;

pivotally attaching said support arm to said base so that said support arm and said support head pivot between a closed position and an open position;

supporting said body portions of said musical instruments at a third support location with said support head when said support arm is located in said open position.

6. The method of claim 5 further comprising:

placing protective pads on said base and said support head to prevent damage to said musical instruments.

7. The method of claim 6 further comprising:

providing a support head detent in said base that allows said support head to be recessed in said base when said support arm is in said closed position.

8. The method of claim 5 further comprising:

pivotally attaching two neck hangers to said support arm adjacent to said support head that pivot to an extended position to support a tuning head of said musical instruments.

* * * * *